US011518594B1

(12) United States Patent
Smith

(10) Patent No.: US 11,518,594 B1
(45) Date of Patent: Dec. 6, 2022

(54) VACUUM WRAP BARRIER

(71) Applicant: Garrett Dillon Smith, Murfreesboro, TN (US)

(72) Inventor: Garrett Dillon Smith, Murfreesboro, TN (US)

( * ) Notice: Subject to any disclaimer, the term of this patent is extended or adjusted under 35 U.S.C. 154(b) by 1156 days.

(21) Appl. No.: 16/050,104

(22) Filed: Jul. 31, 2018

Related U.S. Application Data

(60) Provisional application No. 62/539,856, filed on Aug. 1, 2017.

(51) Int. Cl.
*B65D 65/10* (2006.01)
*A47L 9/02* (2006.01)
*A47L 9/06* (2006.01)

(52) U.S. Cl.
CPC ..... *B65D 65/10* (2013.01); *A47L 9/02* (2013.01); *A47L 9/06* (2013.01); *A47L 9/0686* (2013.01)

(58) Field of Classification Search
CPC . A47L 9/0686; A47L 9/02; A47L 9/06; B65D 65/10
See application file for complete search history.

(56) References Cited

U.S. PATENT DOCUMENTS 2,243,935 A 6/1941 Williamson
4,472,222 A * 9/1984 Moisson ..... G02B 6/4476 174/DIG. 8
4,810,194 A 3/1989 Snedden
4,907,968 A 3/1990 Eisner et al.
5,074,008 A 12/1991 Palomino, Jr.
5,228,851 A 7/1993 Burton
5,267,860 A 12/1993 Ingram, Jr. et al.
5,399,381 A 3/1995 Randall
5,921,776 A 7/1999 Heilbrunn
6,068,476 A 5/2000 Point
6,402,511 B1 6/2002 Calderwood
7,131,839 B2 11/2006 March
7,409,745 B2 8/2008 Dodson et al.
9,883,780 B2 2/2018 Kim et al.
2009/0100636 A1 4/2009 Sohn et al.
2013/0277269 A1* 10/2013 Zhao ..... B65D 85/48 206/719
2018/0186532 A1* 7/2018 Lindberg ..... B65D 85/671

FOREIGN PATENT DOCUMENTS

EP 0898925 A1 3/1999
FR 2838039 A1 10/2003

* cited by examiner

*Primary Examiner* — George R Koch
*Assistant Examiner* — Christopher C Caillouet
(74) *Attorney, Agent, or Firm* — Bradley Arant Boult Cummings; Timothy L. Capria

(57) ABSTRACT

The present disclosure relates to a wrap element for attaching to a cleaning device. The wrap element may include a sheet of barrier material. The sheet may include first and second edges extending along the sheet in a longitudinal direction. Third and fourth edges may extend along the sheet in a direction orthogonal to the first and second edges. A folded over portion may extend in the longitudinal direction along a majority of the first edge. Fasteners may be disposed on the sheet, such as nearer the third edge than the fourth edge and may extend in the direction orthogonal to the first edge along a majority of the third edge. The fasteners may allow the sheet of barrier material to removably connect to itself. A fit indicator may extend in the longitudinal direction along a majority of the first edge.

20 Claims, 11 Drawing Sheets

VACUUM WRAP BARRIER

This is a Nonprovisional patent application for the invention by Garrett Smith, a citizen of the United States, residing in Murfreesboro, Tenn., for a "VACUUM WRAP BARRIER" This application claims priority to U.S. Provisional Patent Application No. 62/539,856, filed Aug. 1, 2017, which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

All patents and publications described or discussed herein are hereby incorporated by reference in their entireties.

TECHNICAL FIELD

The present disclosure relates generally to barriers for a cleaning device attachment. More specifically, the present disclosure relates to barriers for cleaning device attachments that protect a user of the cleaning device attachment, and the user's property, from contacting unsanitary cleaning device attachments. Briefly, the present disclosure relates, in one embodiment, a barrier having a body constructed of a flexible polymer, the body including: a first edge comprising an indentation; a second edge generally extending orthogonally to the first edge; and one or more fasteners disposed proximate to the second edge, the fasteners configured to removably fasten the barrier to itself to form a sleeve.

BACKGROUND

Vacuums can be used for a variety of purposes, including cleaning an area of contaminants or other materials, such as debris and general refuse. One popular use of vacuums is at commercial car washes, which enable customers to vacuum their car interiors. Such vacuums are popular, especially when customers have purchased an exterior car wash.

Public vacuums at a car wash, for instance, may be used to clean spilled beverages, food trapped between seats, or contamination or other dirty substances. Typically, public vacuums use a suction source and a handheld attachment for the user to direct suction, such as to vacuum automobile floors and seats. Public vacuum attachments can be contaminated with fecal matter, pathogenic organisms, and other unhygienic or harmful contaminants. The contamination can be spread from automobile floors to areas like cup holders and trays, which directly contain items (e.g., cups and mobile devices), and even child seats, that come into direct contact with people, such that contamination is spread.

What is needed, therefore, is a method and apparatus to prevent the spread of any potential residue, bacteria, viruses, and the like from a vacuum nozzle to a user and the user's property.

BRIEF SUMMARY

Briefly, the present disclosure relates, in one embodiment, to a barrier having a body constructed of a flexible polymer, the body including: a first edge comprising an indentation; a second edge generally extending orthogonally to the first edge; and one or more fasteners disposed proximate to the second edge, the fasteners configured to removably fasten the barrier to itself to form a sleeve. The fasteners may comprise hook and loop fasteners or hook and hook fasteners. The sleeve may be configured to be disposed around a cleaning device. The cleaning device may be a nozzle of a commercial automobile vacuum. The indentation may be continuously curve inward. The barrier may be constructed of a flexible polymer.

In an embodiment, a method of providing a barrier on a cleaning device is provided. The method includes placing an attachment of the cleaning device on the barrier such that a first edge of the barrier extends beyond an open end of the attachment. The method includes wrapping the barrier around the attachment such that a third edge and a fourth edge overlap each other. The method includes removably securing the barrier to itself and bending the barrier such that the first edge is received inside of the open end of the attachment. The barrier may not be directly fastened to the cleaning device. The barrier may be removably secured to itself by one or more hook and loop fasteners or one or more hook and hook fasteners. One or more of the hooks of the fasteners may be disposed nearer the third edge than the fourth edge. One or more of the loops of the fasteners may be disposed nearer the fourth edge than the third edge.

The method may include, after powering the cleaning device, vacuuming an automobile interior with the attachment. The method may include, after the barrier is secured to itself, advancing the barrier material toward the open end of the attachment. The advancing may comprise more than one incremental advancements. The method may include releasing the barrier from itself.

In an embodiment, a wrap for attaching to a cleaning device is described. The wrap includes a sheet of barrier material, the sheet including a first edge, a second edge, a third edge, and a fourth edge. The first edge and the second edge extend along the sheet in a longitudinal direction, and the third edge and the fourth edge extend along the sheet in a direction orthogonal to the first edge and the second edge. The sheet includes a folded portion extending in the longitudinal direction along a majority of the first edge. The sheet includes a section of hooks disposed nearer the third edge than the fourth edge, and a section of loops disposed nearer the fourth edge than the third edge, the section of loops configured to receive the section of hooks to allow the sheet of barrier material to be removably connected to itself. The sheet comprises a fit indication line extending in the longitudinal direction along a majority of the first edge. The curved indentation may contact the fit indication line.

DETAILED DESCRIPTION

Figure 1:
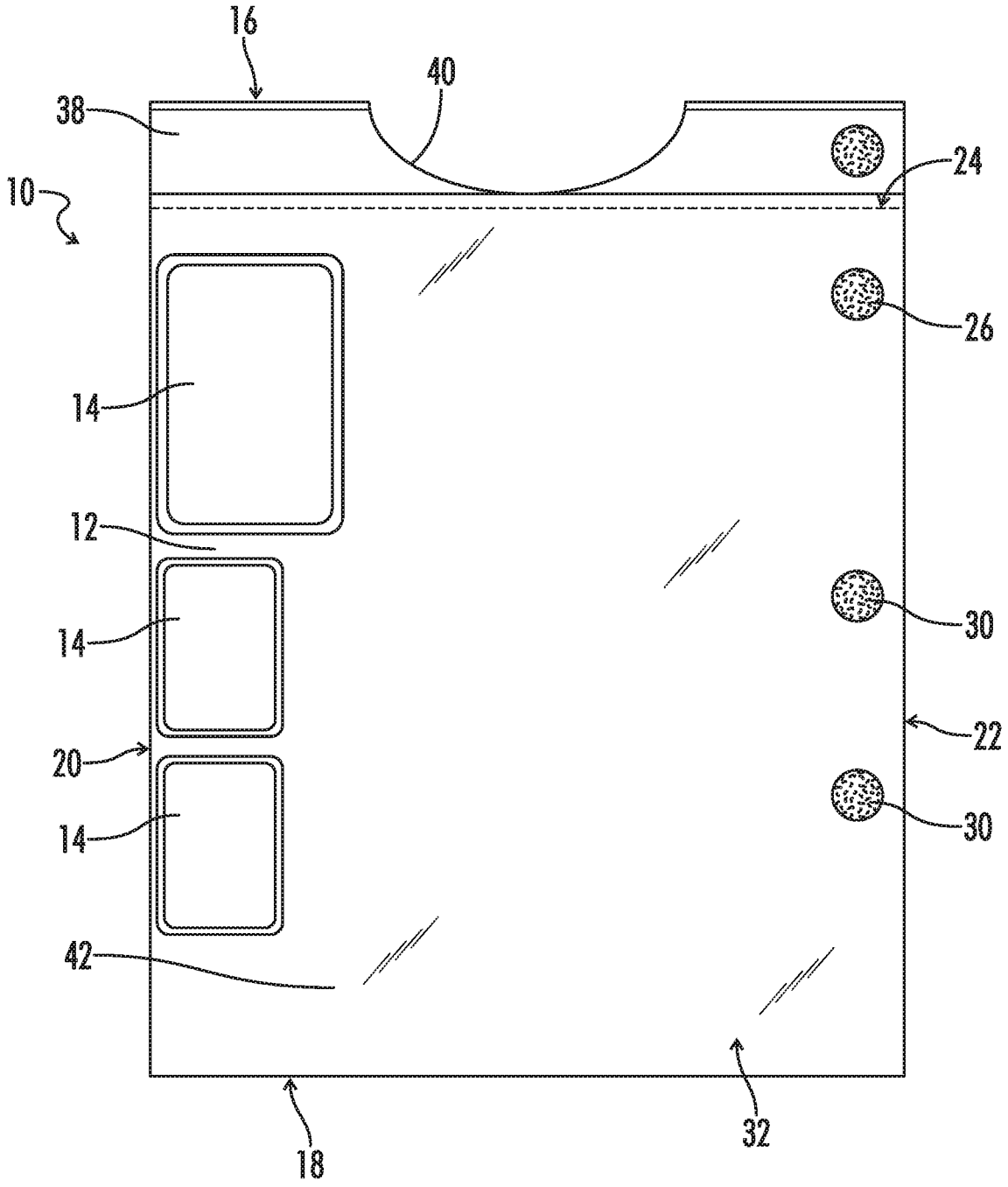
FIG. 1 is a front perspective view of one embodiment of the barrier.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations that come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, paper, kraft paper, a mesh, wood, composite, or any combination thereof.

Referring to FIGS. 1-11, a barrier 10 for engaging to a cleaning device 2 is shown. The cleaning device 2 may be, for example, an attachment to a vacuum, such as a hose and nozzle, such as those found at commercial automobile washes. The barrier 10 may cover at least a portion of the cleaning device 2. In some embodiments, the barrier 10 covers a nozzle 4, or attachment, and a gripping portion 6 of the cleaning device 2. The nozzle 4 includes an open suctioning end 8.

The barrier 10 may act as a barrier to prevent the spread of contaminants, bacteria, viruses, and pathogens and illnesses associated therewith. In particular, the barrier 10 is configured to at least partially wrap the cleaning device 2 such that the user and the object that the user is cleaning (e.g., an automobile) directly contact the barrier 10 rather than the cleaning device 2.

Figure 5:
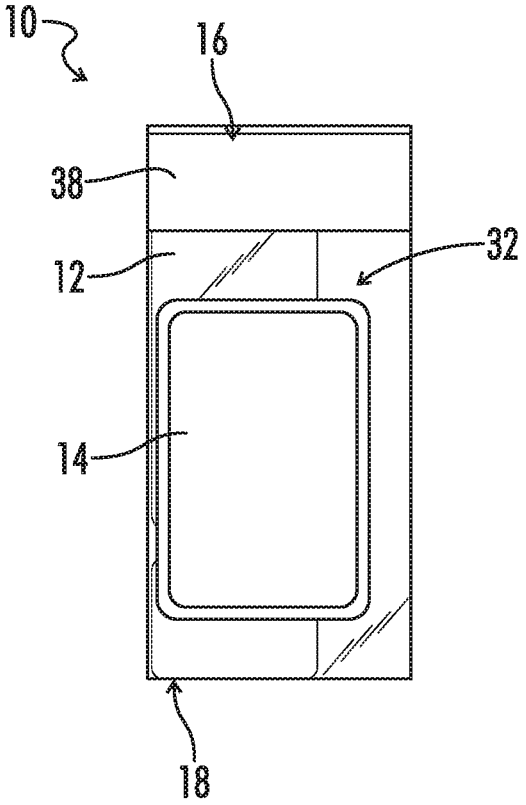
FIG. 5 is a front perspective view of a folded barrier.

The barrier 10 may include a body 12. The body 12 may be constructed of a barrier material, such as a film, a web, a sheet, a wrap, a lamination, or a thin and flexible polymer. In some embodiments, the body 12 may be constructed of a clear (i.e., transparent) polymer. Examples of polymers include polyethylene, polypropylene, and polyester. In an embodiment, the body 12 has a thickness of from 0.1 mm to 10 mm, from 0.5 mm to 5 mm, from 1 mm to 3 mm, or about 1.5 mm. The body 12 may be constructed of a material that is durable enough to withstand the suction, agitation, and friction of use of the cleaning device 2, while being also sufficiently flexible such that it can be at least partially received within the open end 8. The body 12 may be provided pre-folded (as shown in FIG. 5) such that the barrier 10 is more space efficient for packaging and storage, and moreover, the folds of the pre-fold barrier 10 provide guides along which the barrier 10 can wrap around the cleaning device 2.

The body 12 may have one or more graphics 14 printed thereon. The graphics 14 may include instructions for use or installation and removal on the cleaning device 2. The body 12 may be flexible and foldable so that it can be manipulated to cooperatively couple with the cleaning device 2.

The body 12 may include a first edge 16 and a second edge 18 disposed oppositely on the body 12 from the first edge 16. Each of the first edge 16 and the second edge 18 may extend along the body 12 in a longitudinal direction. The body 12 may include a third edge 20 and a fourth edge 22 disposed oppositely on the body 12 from the third edge 20. Each of the third edge 20 and the fourth edge 22 may extend along the body 12 in a direction orthogonal to the longitudinal direction. The length of the third and fourth edges 20, 22 may be extended and shortened depending on desired area to be covered on the cleaning device 2.

The body 12 may comprise a fold 24. The fold 24 may extend along the body 12 in the longitudinal direction along at least part of the first edge 16. In some embodiments, the fold 24 may extend along at least half (e.g., a majority), a substantial part, or all of the first edge 16. The fold 24 may be configured to allow the first edge 16 to be suctioned within the nozzle 4 of the cleaning device 2 such that exterior surfaces 9 of the nozzle 4 are covered by the barrier 10 when the cleaning device 2 is in-use. The first edge 16 may be suctioned within the open end 8 of the nozzle.

Figure 2:
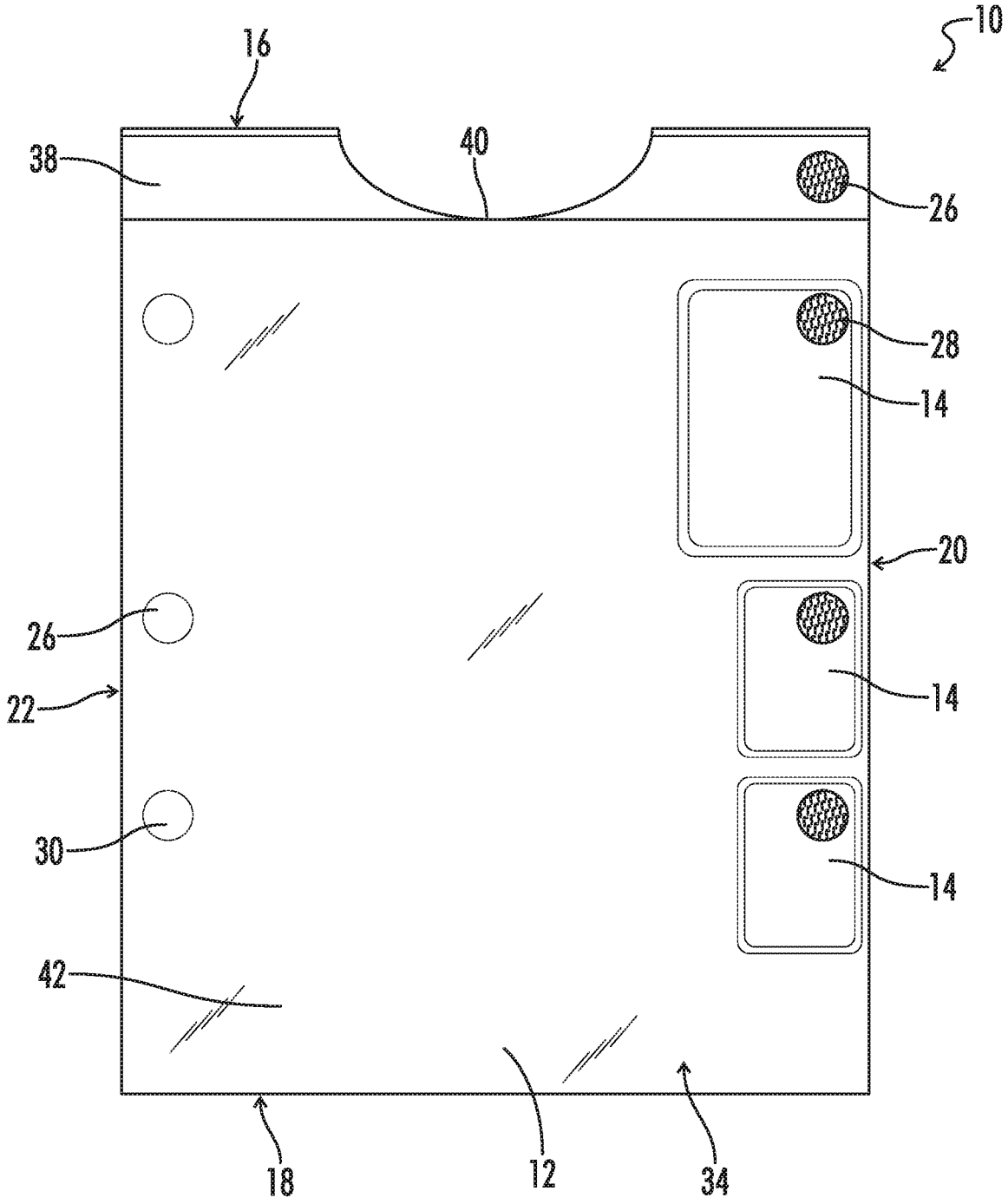
FIG. 2 is a rear perspective view of barrier of FIG. 1.
Figure 3:
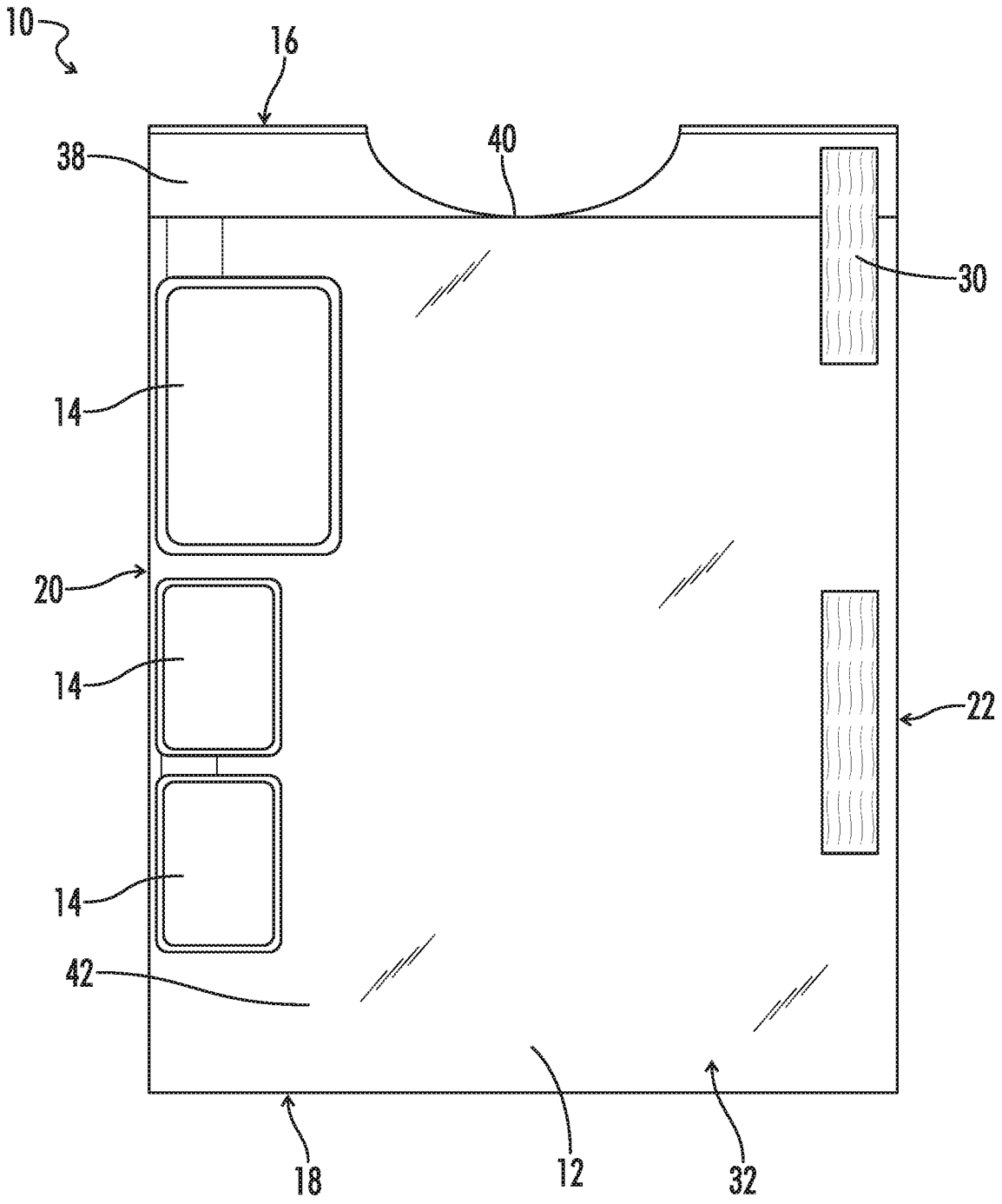
FIG. 3 is a front perspective view of an embodiment of the barrier.
Figure 4:
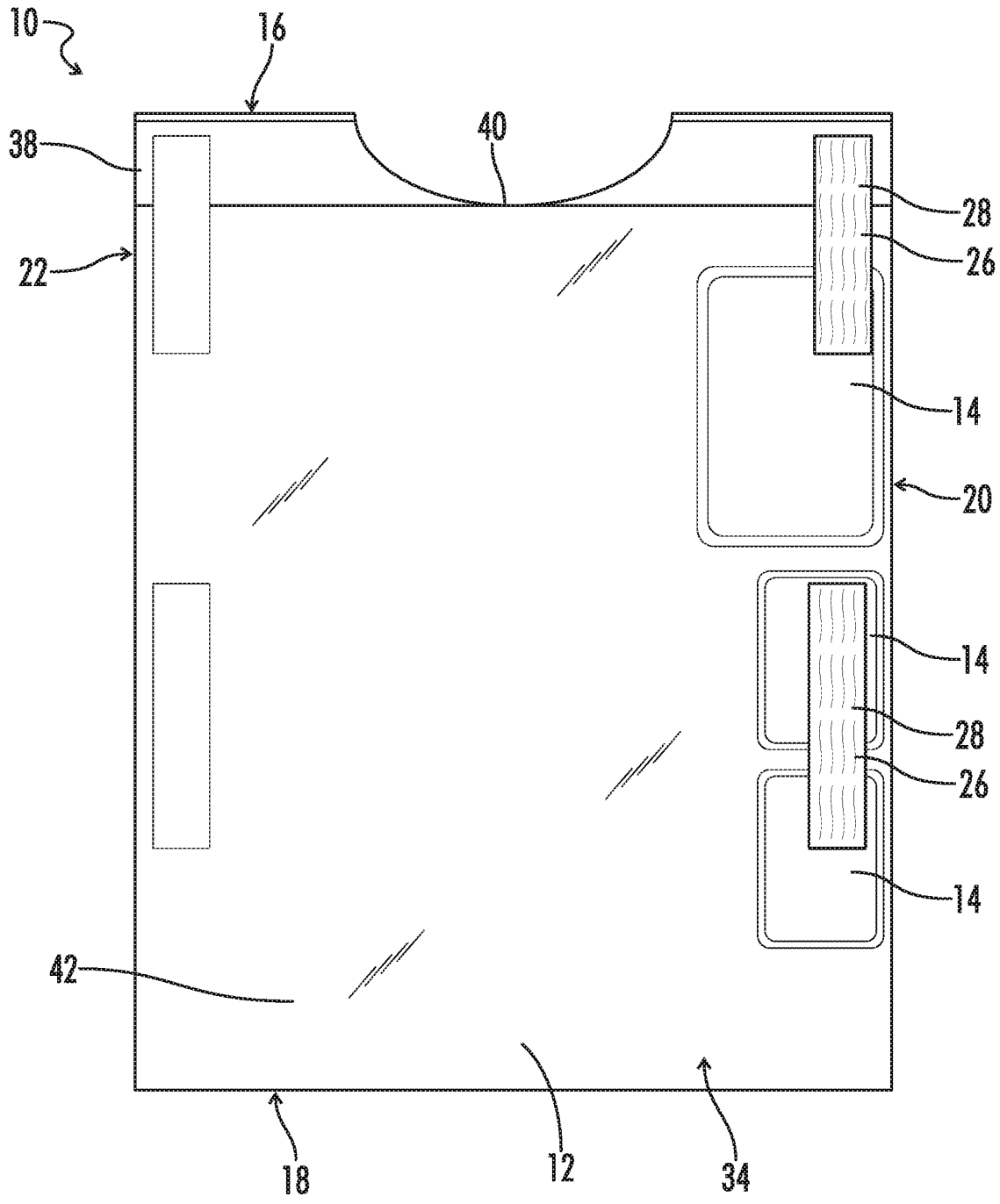
FIG. 4 is a rear perspective view of barrier of FIG. 3.

The body 12 may comprise one or more fasteners 26 that allow the body 12 to be removable and cooperatively couple with the cleaning device 2. In one embodiment, the fasteners 26 are configured such that body 12 can fasten with itself such that body 12 forms a sleeve around at least part of the cleaning device 2. The fasteners 26 may be a hook and loop fastener (as shown in FIGS. 1 and 2), a hook and hook fastener, or an adhesive (as shown in FIGS. 3 and 4). Embodiments of the barrier 10 which comprise hook and loop fasteners or hook and hook fasteners may be particularly advantageous, as they include an engagement portion 28 and a receiving portion 30 which correspond to each other and provide a user-friendly way for the user to align and fasten the fasteners 26, as the user is able to match the respective engagement portion 28 and receiving portion 30 of the fasteners, avoiding the need for complicated instructions. The fasteners 26 may be spaced, such as evenly spaced, along an edge 20, 22 of the body 12. The fasteners 26 may be circular, rectangular, oval, or any other suitable shape in profile. In one embodiment of the barrier 10, the fasteners 26 are self-adhesive circular hook and loop fasteners.

The body 12 may include a face surface 32 and a rear surface 34. The graphics 14 may be disposed, such as printed on, at least part of the face surface 32. The fasteners 26 may be provided on the rear surface 34. The fasteners 26 may be positioned on the rear surface 34 at a position that corresponds with the graphics 14 such that the graphics 14 obscure, or mostly hide, the fasteners 26 when the body 12 is viewed from the face surface 32. This feature is advantageous, as it enables the barrier 10 to be aesthetically pleasing when viewed from the face surface 32.

The engagement portion 28 of the fasteners 26 (e.g., the hooks or adhesive) may be disposed nearer to the third edge 20 than the fourth edge 22, or proximate to the third edge 20. The receiving portion 30 of the fasteners 26 (e.g., loops or substrate configured for adhesive) may be disposed nearer to the fourth edge 22 than the third edge 20, or proximate to the fourth edge 22, so that the engagement portion 28 and the receiving portion 30 securely couple to one another such that body 12 forms an overlap 36 and the barrier 10 is removably connected to itself. The overlap 36 may provide a relatively thicker barrier such that tears in the barrier 10 are at least somewhat prevented during use of the cleaning device.

The barrier 10 may include a fit indicator 38, such as a fit indication graphic line or band, that extends in the longitudinal direction along at least part of, at least half (e.g., a majority), a substantial part, or all of the first edge 16. The fit indicator 38 may indicate to the user where to align the engagement portion 28 and the receiving portion 30 of the fasteners 26, providing a user-friendly indication of how to align the portions 28, 30.

The barrier 10 may include an indentation 40, or curved edge, along one or more of the edges 16, 18, 20, 22. The indentation 40 may be disposed along the first edge 16 of the body 12. The indentation 40 may inwardly curve, such as to have a continuously curve profile (i.e., concave). In some embodiments, the indentation 40 may be rectangular in profile (not shown). The profile of the indentation 40 may be formed to cooperatively engage the cleaning device 2, such as the nozzle 4. The indentation 40 may contact the indicator 38. The indentation 40 may be located on the underside of the nozzle 4 of the cleaning device 2 (or the side of the cleaning device 2 that is closer to the user when held during use by the user). The indentation 40 may prevent the barrier 10 from blocking the open end 8.

The indicator 38 may indicate the portion of the barrier 10 that is configured to be suctioned within the nozzle 4. In some embodiments, the first edge 16 may be suctioned into the nozzle 4 to fully fit the barrier 10 on the cleaning device 4. The indicator 38 may indicate to a user how to position the barrier 10 on the cleaning device 4. The placement according to the indicator 38 allows the first edge 16 to be received in the opening of the cleaning device 4 without substantially blocking the opening of the open end 8.

The barrier 10 may include a hold portion 42 for holding the cleaning device 4. Advantageously, the hold portion 42 enables the user to hold the cleaning device 4 while providing a barrier between the user and the cleaning device 4 to avoid the spread of contaminants from the cleaning device 2 to the user. The hold portion 42 may be integrally formed with the body 12.

The barrier 10 may be a temporary, disposable, and/or reuseable. In such embodiments of the barrier 10 that are reusable, the barrier 10 may be configured to allow a user to wash the barrier 10 without damaging or mining the fasteners 26. For example, the fasteners 26 may be waterproof, such as waterproof adhesive, or may include hook and hook or hook and loop fasteners. The fasteners 26 may be color-coded (e.g., green with green and red with red) such that users are able to easily see how to secure the fasteners 26.

Figure 6:
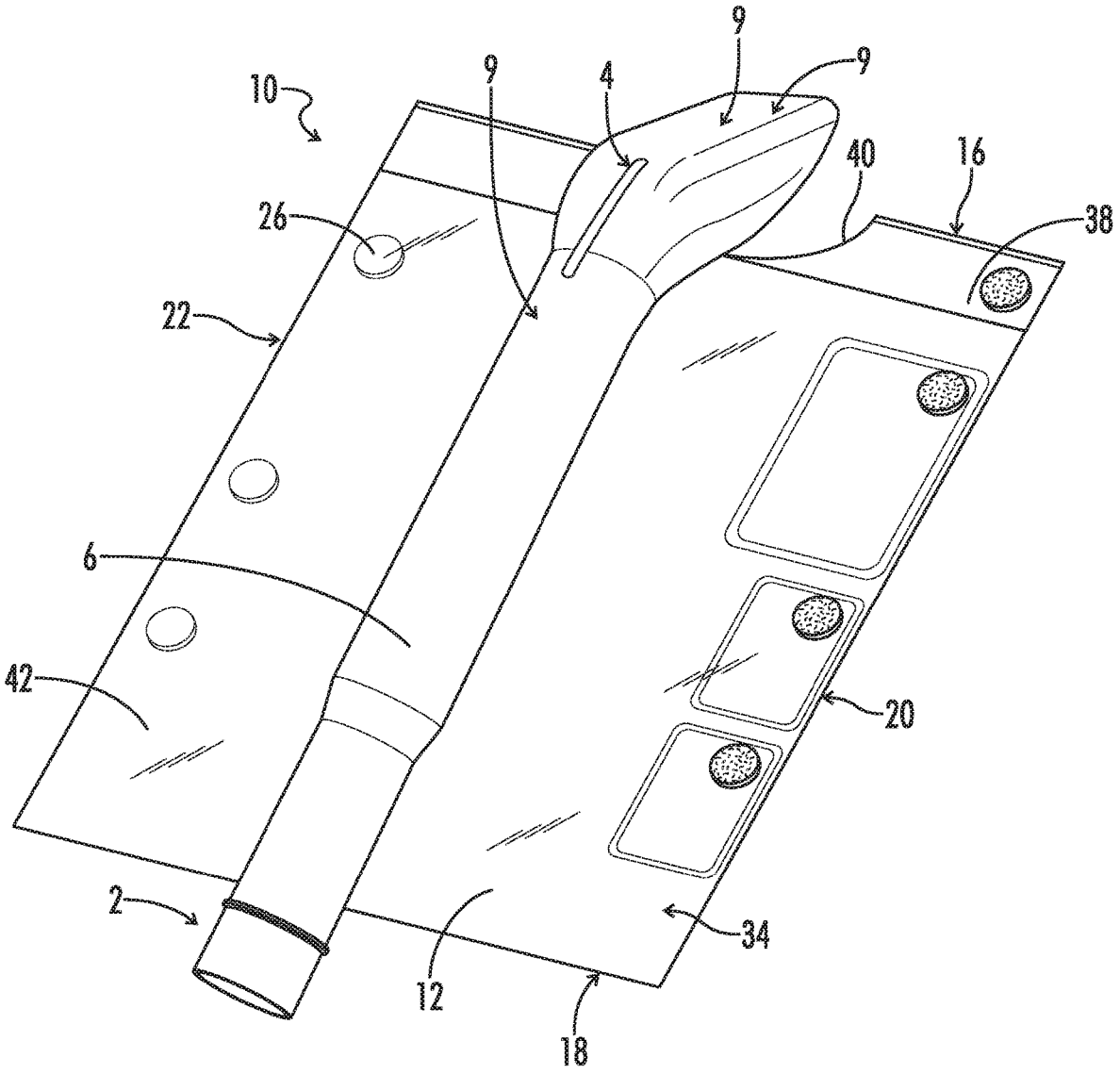
FIG. 6 is a perspective view of an embodiment of a cleaning device positioned on a barrier.
Figure 7:
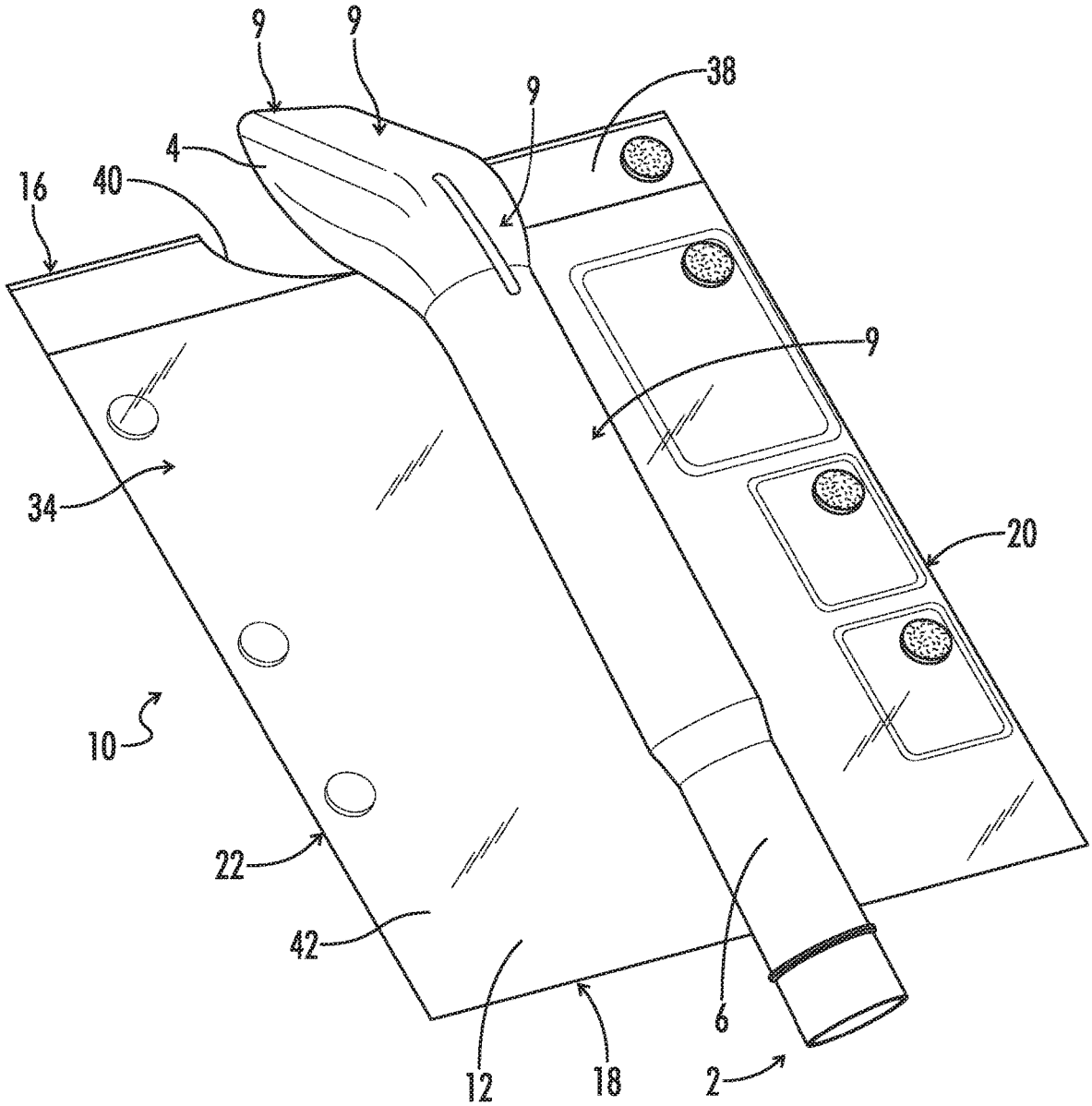
FIG. 7 is an alternate perspective view of the cleaning device and barrier of FIG. 6.
Figure 8:
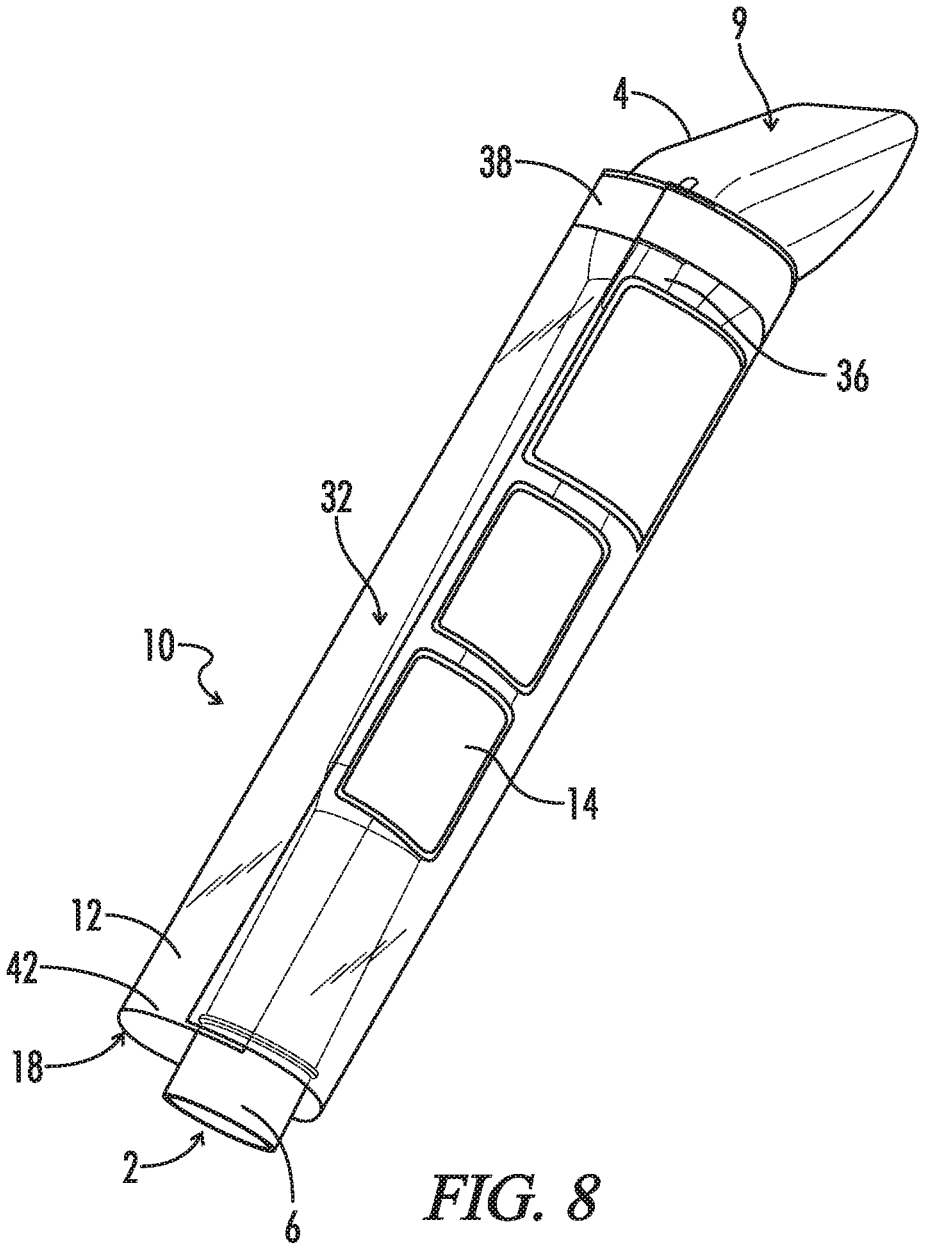
FIG. 8 is a perspective view of a barrier wrapped around the cleaning device.
Figure 9:
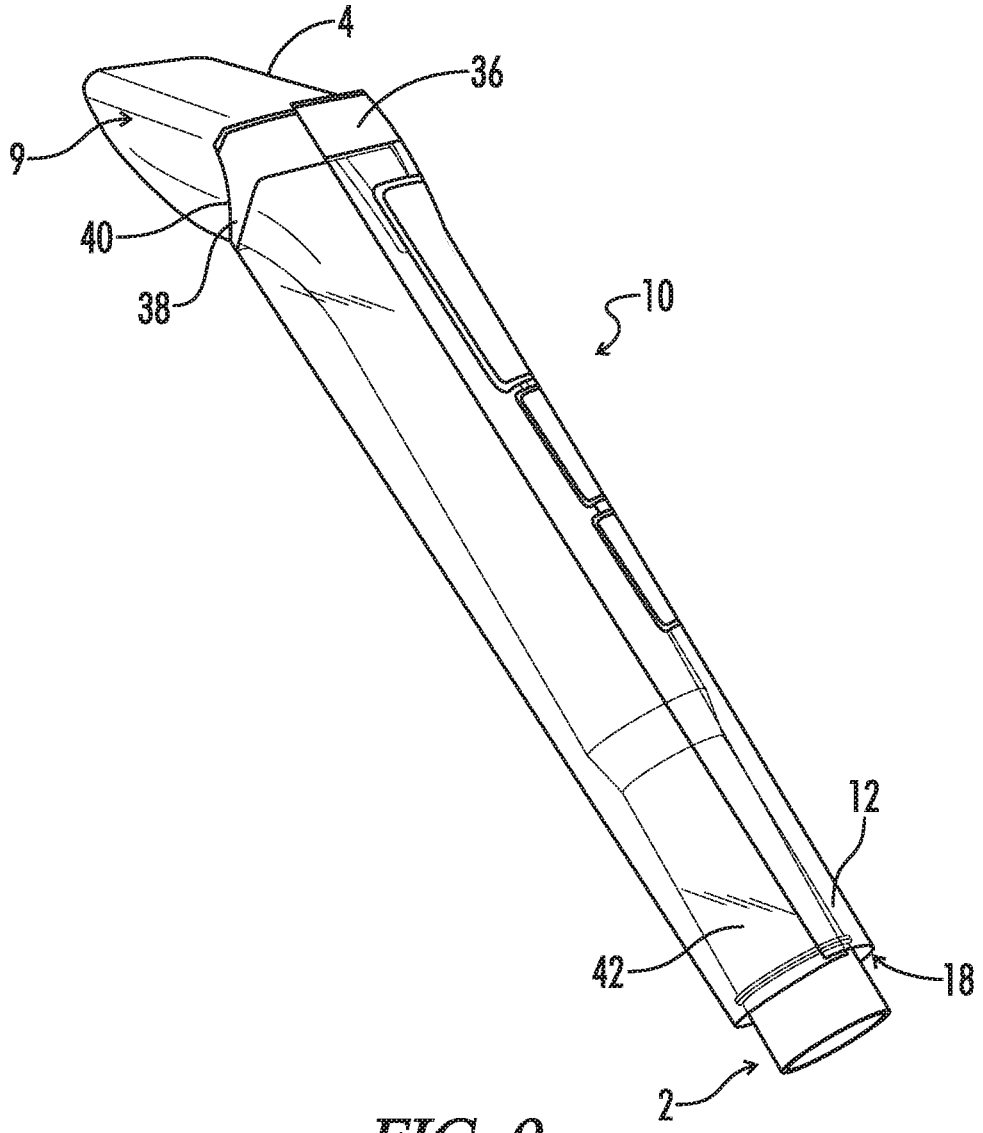
FIG. 9 is an alternate perspective view of the barrier wrapped around the cleaning device of FIG. 8.
Figure 10:
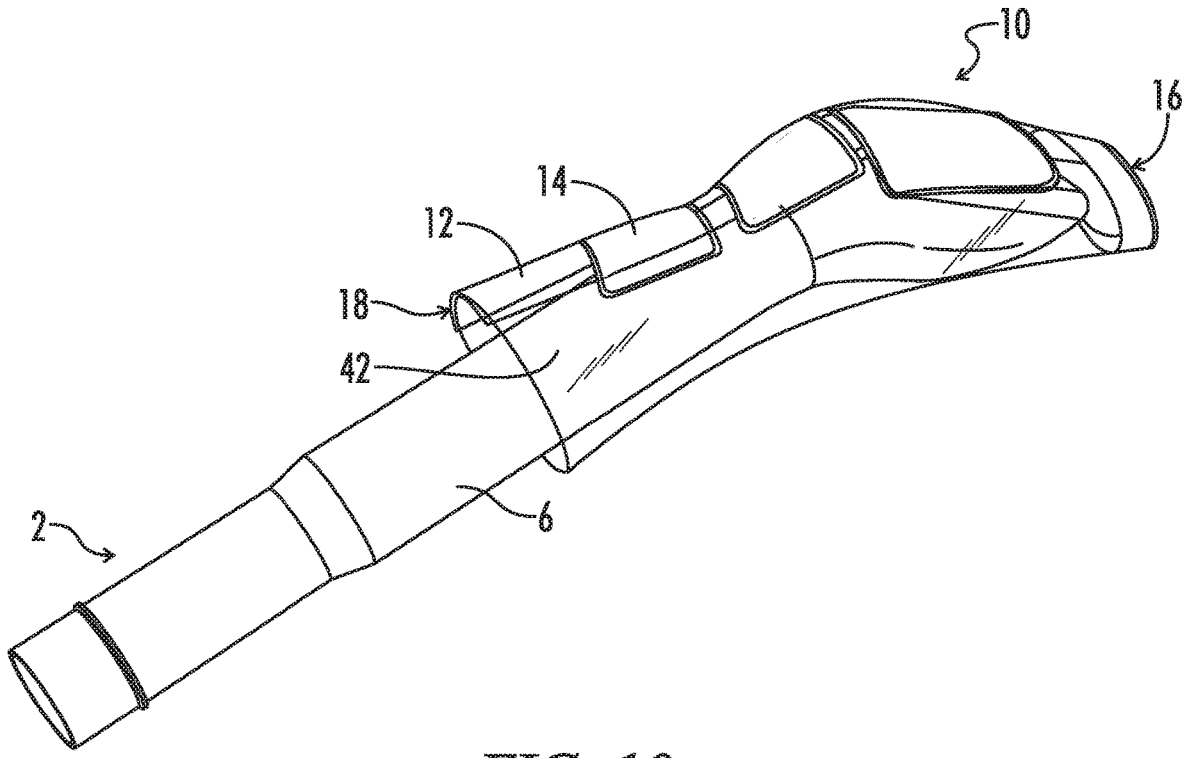
FIG. 10 is a perspective view of a barrier advanced on the cleaning device.
Figure 11:
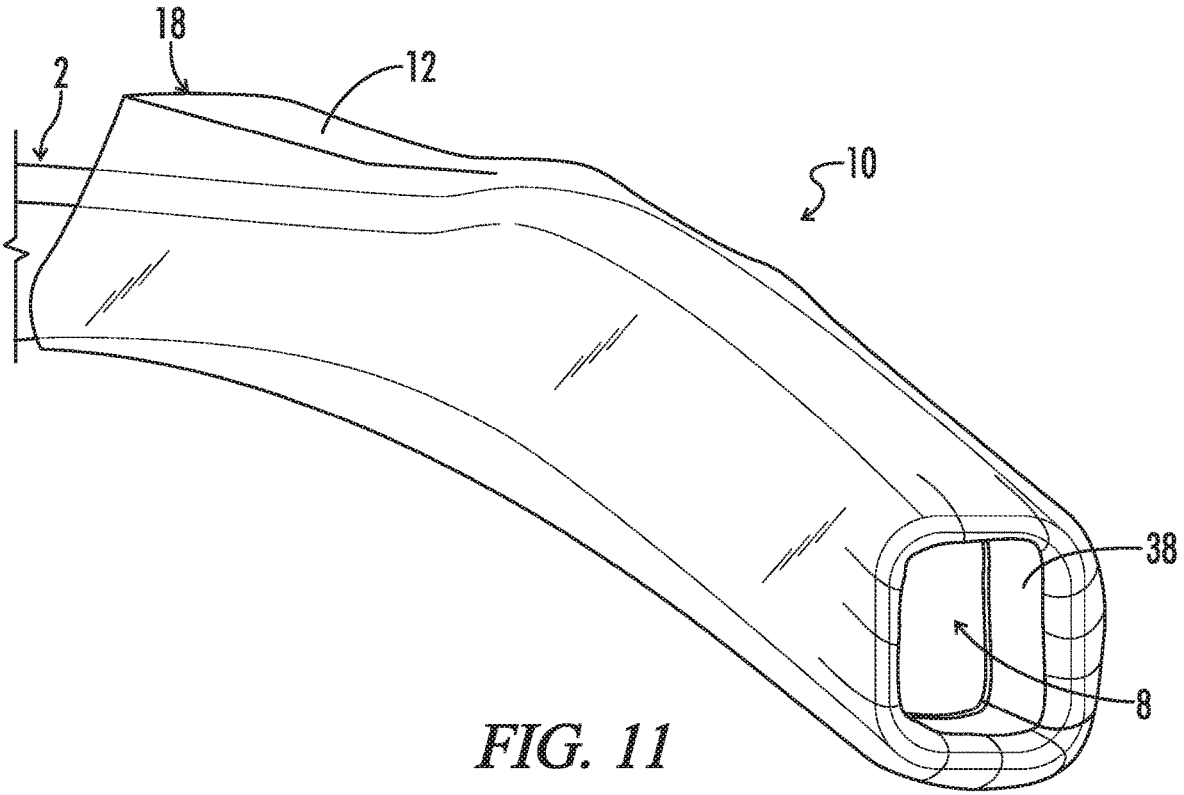
FIG. 11 is a perspective view of a barrier disposed within an open end of the cleaning device.

As shown in FIGS. 6-11, a method of providing the barrier 10 on a cleaning device 2 is disclosed. The method(s) disclosed herein may be performed in any order unless expressly provided or otherwise clear from the context. As illustrated in FIG. 6, the method may include placing an attachment 4 of the cleaning device 2 on the barrier 10 such that the first edge 16 of the barrier 10 extends beyond the open end 8 of the attachment 4. As shown in FIG. 7, the method may include wrapping the barrier 10 around the attachment 4 such that the third edge 20 and the fourth edge 22 overlap with each other to form the overlap 36. As shown in FIGS. 8-10, the barrier 10 may be secured, or fastened, to itself around the attachment 4. FIG. 11 shows the barrier 10 may be deformed, or bent, such that the first edge 16 is received inside of the open end 8 of the attachment 4. The method may include powering the cleaning device 2 to suction the first edge 16 into the open end 8 of the attachment 4. The method may include, after powering the cleaning device 2, vacuuming an automobile interior with the attachment 4.

The barrier 10 may not be directly fastened to the cleaning device 2, that is, does not have a fastener that connects directly from the barrier 10 to the cleaning device 2. The barrier 10 may be removably secured to itself by the one or more fasteners 26.

The method may include, after the barrier 10 is secured to itself and around the attachment 4, advancing the barrier 10 toward the open end 8 of the attachment 4. FIG. 10 illustrates an embodiment of the barrier 10 in an advanced position. The advancing may comprise one or more incremental advancements, such as in a shimmying or inchworm motion. The method may include releasing the barrier 10 from itself and disengaging, or uncoupling, the barrier 10 from the attachment 4. To release the barrier 10, the user may pull on the third edge 20 of the barrier 10 to disconnect the barrier 10 and disassociate, or disengage, the barrier from the attachment 4 of the cleaning device 2.

It should be understood that the barrier 10 may be any appropriate size or shape to fit on any corresponding cleaning device. The barrier 10 may cover a handheld vacuum nozzle in some embodiments and may cover an opening of a standing vacuum in other embodiments. All vacuum openings are contemplated, and a person having ordinary skill would know how to modify the illustrated embodiments to utilize the benefits and features of the present disclosure on a nozzle or opening of a different shape or size.

This written description uses examples to disclose the invention and also to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. While specific uses for the subject matter of the disclosure have been exemplified, other uses are contemplated. Therefore, the spirit and scope of the appended claims should not be limited to the description of the versions contained herein.

What is claimed is:

1. A method of providing a barrier on a cleaning device, the method comprising:

providing a wrap for attaching to a cleaning device, the wrap comprising:

a sheet of barrier material, the sheet including:

a first edge and a second edge extending along the sheet in a longitudinal direction;

a third edge and a fourth edge extending along the sheet in a direction orthogonal to the first edge and the second edge; and a folded portion extending in the longitudinal direction along a majority of the first edge;

a fastener configured to attach an area proximate to the third edge with an area proximate to the fourth edge, the fastener configured to allow the sheet of barrier material removably connect to itself; and a fit indication line extending in the longitudinal direction along a majority of the first edge placing an attachment of the cleaning device on the sheet of barrier material such that the first edge of the sheet of barrier material extends beyond an open end of the attachment;

wrapping the sheet of barrier material around the attachment such that the third edge and the fourth edge overlap each other;

removably securing the sheet of barrier material to itself; and bending the sheet of harrier material such that the first edge is received inside of the open end of the attachment.

2. The method of claim 1, wherein the sheet of barrier material is not directly, fastened to the cleaning device.

3. The method of claim 1, wherein the sheet of barrier material is removably secured to itself by one or more hook and loop fasteners or one or more hook and hook fasteners.

4. The method of claim 3, wherein one or more of the hooks of the fasteners are disposed nearer the third edge than the fourth edge.

5. The method of claim 4, wherein one or more of the loops of the fasteners are disposed nearer the fourth edge than the third edge.

6. The method of claim 1, further comprising powering the cleaning device to suction the first edge into the open end of the attachment.

7. The method of claim 6, further comprising, after powering the cleaning device, vacuuming an automobile interior with the attachment.

8. The method of claim 1, further comprising, after the sheet of barrier material is secured to itself, advancing the sheet of barrier material toward the open end of the attachment.

9. The method of claim 8, wherein the advancing comprises more than one incremental advancement.

10. The method of claim 1, wherein the sheet of harrier material is constructed of a flexible polymer.

11. The method of claim 1, further comprising releasing the sheet of barrier material from itself.

12. A wrap for attaching to a cleaning device, the wrap comprising:

a sheet of barrier material, the sheet including:

a first edge and a second edge extending along the sheet in a longitudinal direction;

a third edge and a fourth edge extending along the sheet in a direction orthogonal to the first edge and the second edge; and a folded portion extending in the longitudinal direction along a majority of the first edge;

a fastener configured to attach an area proximate to the third edge with an area proximate to the fourth edge, the fastener configured to allow the sheet of barrier material removably connect to itself; and a fit indication line extending in the longitudinal direction along a majority of the [ ] first edge.

13. The wrap of claim 12, further comprising:

a curved indentation along the first edge.

14. The wrap of claim 13, wherein:

the curved indentation contacts the fit indication line.

15. The wrap of claim 14, wherein the curved indentation is continuously curved inward.

16. The wrap of claim 12, wherein the sheet of barrier material is constructed of a flexible polymer.

17. The wrap of claim 12, wherein the sheet of barrier material is configured to be disposed around a nozzle of a commercial automobile vacuum.

18. The wrap of claim 12, wherein the fastener comprises a hook and loop fastener or a hook and hook fastener.

19. The wrap of claim 12, wherein the fastener comprises two or more fasteners configured to removably attach an area proximate to the third edge with an area proximate to the fourth edge.

20. The wrap of claim 12, wherein the wrap forms a sleeve when the fastener is fastened.

* * * * *